United States Patent [19]

Sergeant

[11] Patent Number: 4,470,181

[45] Date of Patent: Sep. 11, 1984

[54] APPARATUS FOR LOADING COLOR-CODED WIRES INTO A CONNECTOR HALF

[75] Inventor: Ronald G. Sergeant, Winston-Salem, N.C.

[73] Assignee: AMP Incorporated, Harrisburg, Pa.

[21] Appl. No.: 258,142

[22] Filed: Apr. 27, 1981

[51] Int. Cl.[3] ..... H01R 43/00

[52] U.S. Cl. ..... 29/33 M; 29/564.1; 29/748; 29/755

[58] Field of Search ..... 29/33 M, 564.1, 564.2, 29/564.6, 742, 747, 748, 755, 851

[56] References Cited

U.S. PATENT DOCUMENTS

| | | | |
|---|---|---|---|
| 3,816,897 | 6/1974 | Long | 29/755 |
| 3,936,933 | 2/1976 | Polk et al. | 29/755 X |
| 3,995,358 | 12/1976 | Long et al. | 29/749 X |
| 4,107,838 | 8/1978 | Keen et al. | 29/564.1 X |
| 4,171,566 | 10/1979 | Tominoi | 29/748 |
| 4,238,874 | 12/1980 | Chandler et al. | 29/33 M |
| 4,247,980 | 2/1981 | Tominoi | 29/748 X |
| 4,288,908 | 9/1981 | Hatfield | 29/564.1 |
| 4,290,178 | 9/1981 | Friese | 29/33 M |
| 4,308,659 | 1/1982 | Brandewie et al. | 29/748 |

FOREIGN PATENT DOCUMENTS

| | | | |
|---|---|---|---|
| 41332 | 12/1981 | European Pat. Off. | 29/748 |

OTHER PUBLICATIONS

"Automatic Connectorization of 25 Pair Cable", pp. 178–186, Ebrey et al. Int. Wire and Cable Symposium Proceedings, 1980.

*Primary Examiner*—William R. Briggs

*Attorney, Agent, or Firm*—G. K. Kita; R. W. J. Usher

[57] ABSTRACT

Apparatus is disclosed for direct application of color-coded wires into an electrical connector. A notched disc is rotatable in a first direction to drape an individual wire over a row of terminals in the connector half. The wire then escapes from the disc and is fed by a transferring mechanism into an automatic wire trimming and inserting mechanism which loads the wire into a selected terminal.

13 Claims, 14 Drawing Figures

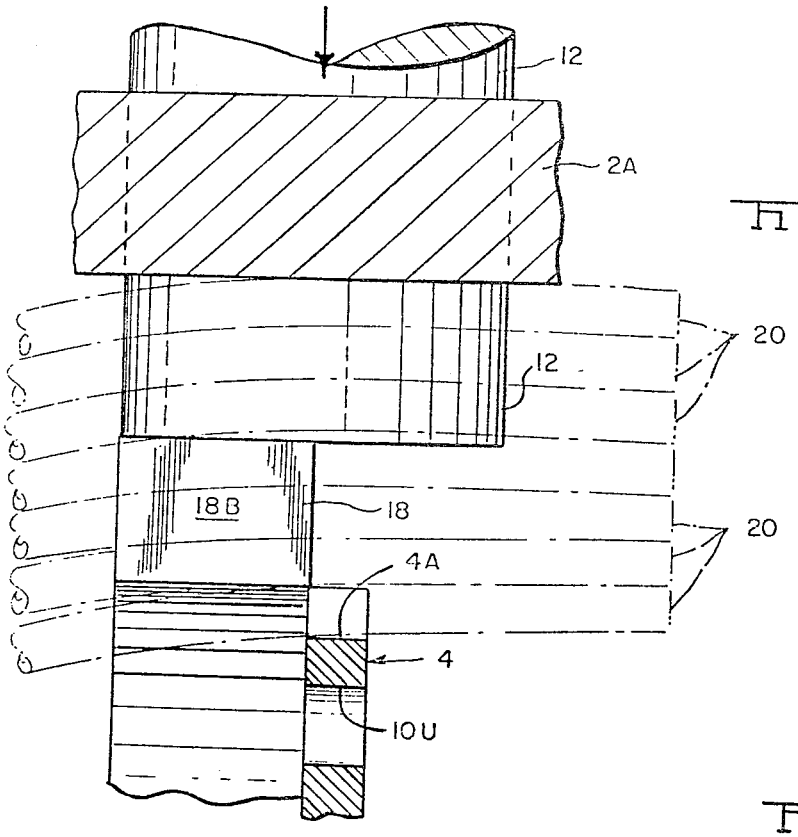
Fig. 2B
Fig. 2C
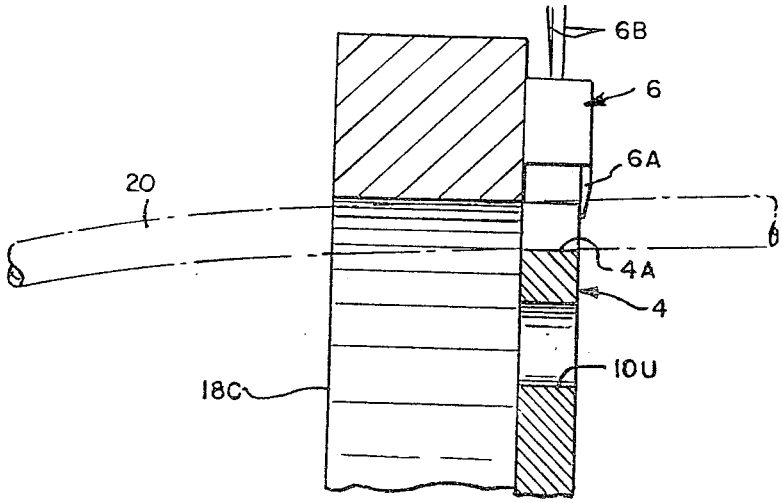

APPARATUS FOR LOADING COLOR-CODED WIRES INTO A CONNECTOR HALF

FIELD OF INVENTION

The present invention relates to fully automatic, direct loading of randomly arranged, color-coded wires of a telephone communications cable into an electrical connector without presorting the wires as an intermediate operation.

BACKGROUND OF THE PRIOR ART

Telephone communications cable consists of an outer sheath covering twenty-five pairs of insulated, color-coded wires. Each pair of wires is twisted to reduce cross talk. Lengths of cable are assembled with a male electrical connector half at one end and a female connector half at the other end to facilitate plugging into a communications apparatus or splicing the lengths of cable end to end. U.S. Pat. No. 3,760,335 discloses solderless versions of these connector halves. Each connector half includes two rows of contacts having wire-connecting portions. The color-coded wires merely are inserted into these connecting portions to establish electrical connections with the contacts.

Semi-automatic apparatus for trimming and inserting the wires is disclosed in each of U.S. Pat. Nos. 3,995,358 and 4,238,874. An operator of the apparatus must manually select each twisted pair of color-coded wires of the cable and present the same to the apparatus. The presented wires activate a pair of reciprocating inserters which trim the wires and insert the wires into corresponding contacts, one into each of the two rows of contacts. The wires are in a random array within the cable sheath and must be assembled within the proper color-coded positions in the connector half. Therefore, the operator must manually sort the color-coded wires in the proper order before presentation to the apparatus. Manual sorting is time consuming and subject to operator error.

Apparatus which automatically sorts the color-coded wires is described in a paper: Ebrey, Roger G.; Sckerl, Herbert A.; *International Wire and Cable Symposium Proceedings* 1980, Pages 178–187. A rotating disc has a periphery provided with a notch which is sized to allow entry of a single wire. As the disc rotates, the individual wire is transferred in a circular path past a knife blade which cuts through the wire insulation and makes electrical contact with the conductor portion of the wire. The wire transmits an electrical signal corresponding to its color coding. The knife blade comprises a sensor which identifies the signal. Repeated operation of the disc results in each wire of a cable being identified by the knife blade. Each identified wire is transferred by the disc to a color-coded position on one of two storage racks. When all of the wires are sorted and placed on the racks in the color-coded arrangement, the racks are transferred to a mechanism which trims the wires and inserts them in a connector half, maintaining the appropriate color-coded arrangement.

SUMMARY OF THE INVENTION

The present invention eliminates collating and sorting of the wires and automatically transfers each color-coded wire of a communications cable directly from a random array into the appropriate color-coded position within a connector half. A single machine station replaces several sequential stations of the prior art, as well as the computerized controllers for operating the mechanisms of each station. Apparatus of the present invention further eliminates the need for retaining wire identities from station to station.

The apparatus of the present invention routes each wire in the most direct path from the cable sheath to the color-coded position in a connector half so that the junction of the cable and connector has an improved wire dress, with minimum bulk, maximum flexibility and neat, orderly appearance.

The apparatus is particularly suited for dividing a long length of communications cable into shorter lengths, automatically applying a connector half to each end of the shorter lengths.

OBJECTS

An object of the present invention is to provide apparatus for automatically sorting individual wires from groups of twisted pairs of wires in a communications cable and for trimming and connecting the wires in a desired arrangement within a solderless electrical connector.

Another object is to provide apparatus for automatically picking up and identifying individual wires from a bundle of wires in a communications cable, then utilizing wire identification as a means for positioning a mechanism in readiness for trimming and electrically connecting the identified wire to a specified terminal within an electrical connector half.

Another object is to provide apparatus for automatically identifying each wire of a multiple-wire cable, and inserting each wire in turn within a solderless electrical terminal selected from two rows of such terminals in an electrical connector.

Another object is to provide apparatus for picking up randomly ordered individual wires of a communications cable and feeding the wires individually to one of a pair of insertion mechanisms which trims each wire and applies the same in an orderly arrangement to solderless terminals in an electrical connector half.

Other objects and many advantages of the present invention will become apparent from the following detailed description in conjunction with the drawings.

DESCRIPTION OF THE DRAWINGS

FIG. 2B is a fragmentary section taken along the line 2B—2B of FIG. 2A.

FIG. 2C is a fragmentary section taken along the line 2C—2C of FIG. 2A.

FIG. 3 is a front elevation of the apparatus according to the present invention.

DETAILED DESCRIPTION

Figure 1:
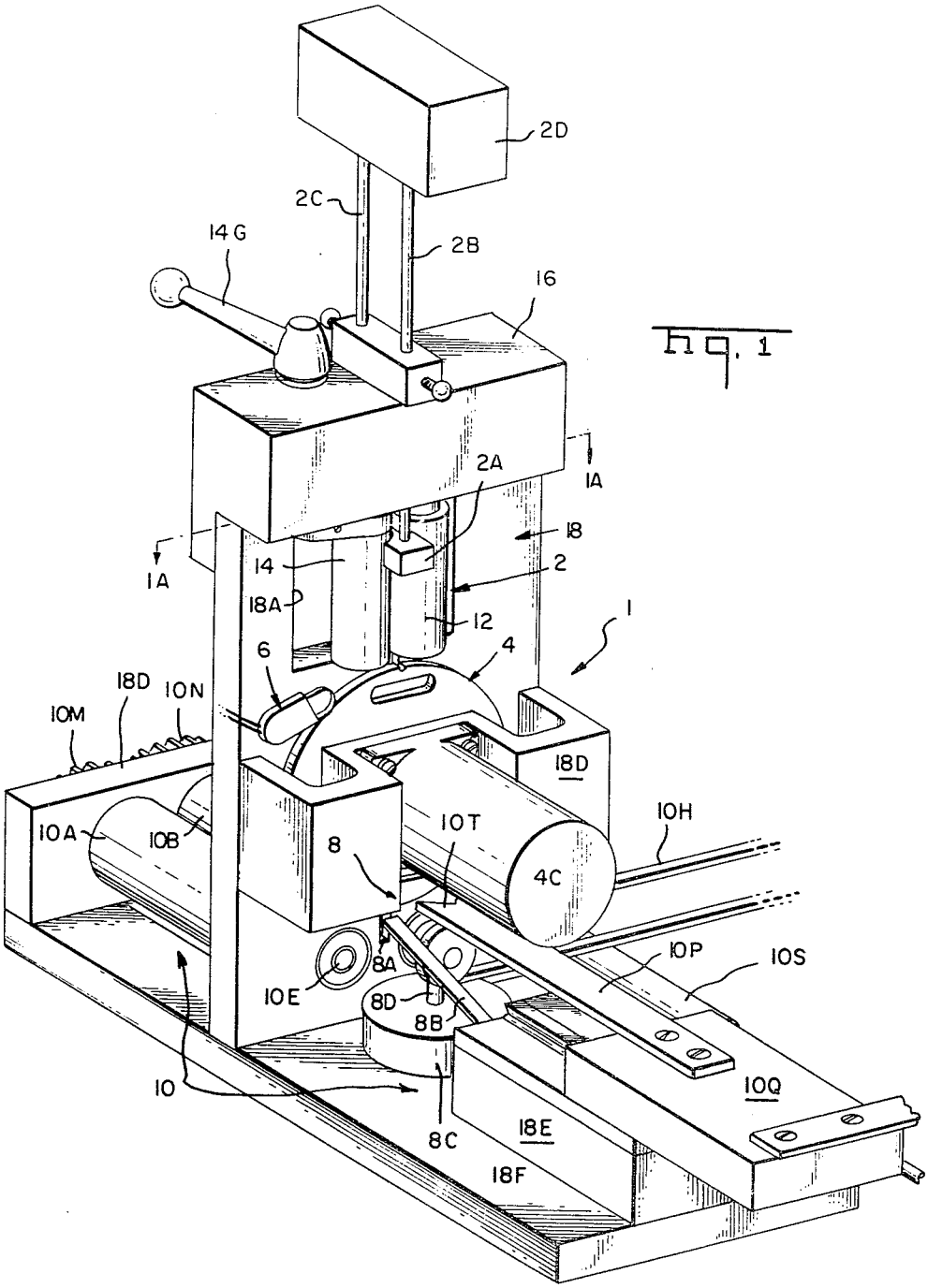
FIG. 1 is a perspective view of a preferred embodiment of a portion of apparatus according to the present invention.

With more particular reference to FIGS. 1–4, apparatus generally shown at 1 comprises a single work station and includes a wire-feeding mechanism 2, a transporting disc 4 for transporting individual wires to a wire identification sensor 6 and then to an escapement mechanism 8. From there, individual wires are impelled by a transfer mechanism 10 into a wire clipping and insertion mechanism to be described in conjunction with FIG. 4.

Figure 1A:
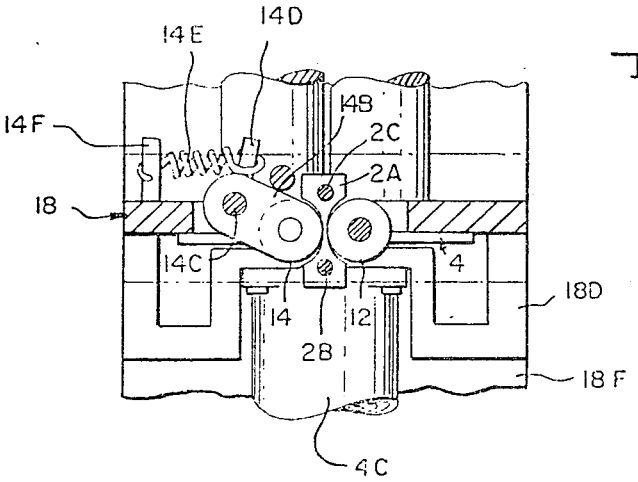
FIG. 1A is a fragmentary section taken along the line 1A—1A of FIG. 1.
Figure 2A:
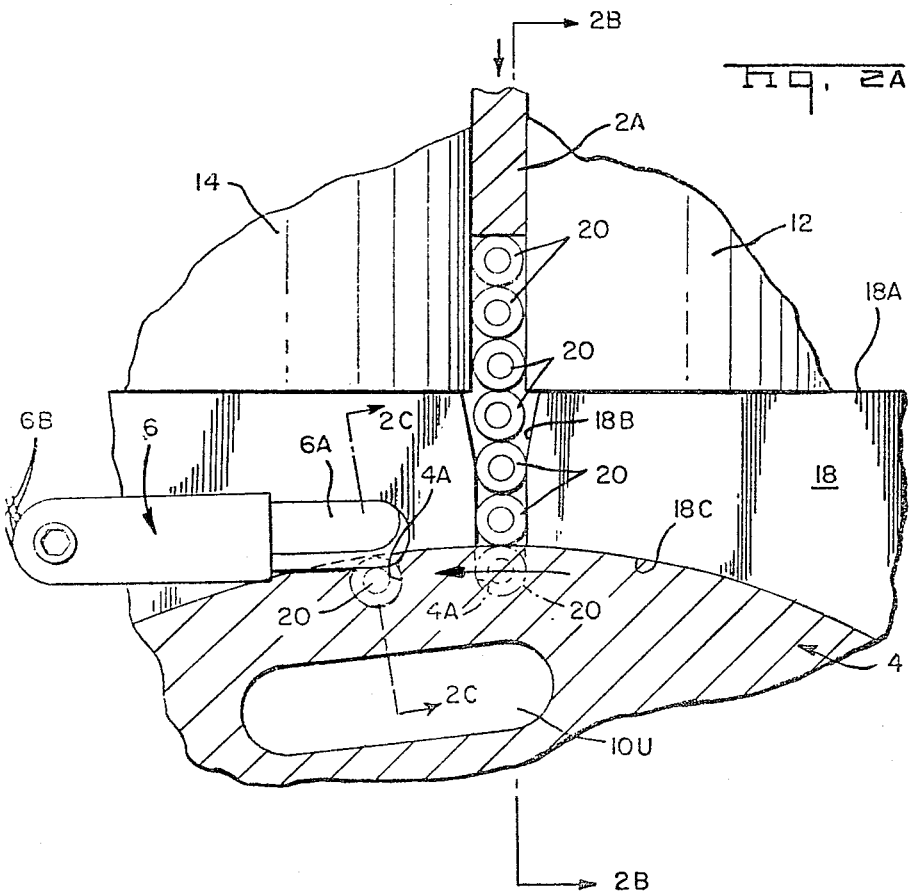
FIG. 2A is an enlarged fragmentary elevation of a wire-feeding mechanism portion of the apparatus portion shown in FIG. 1.
Figure 2:
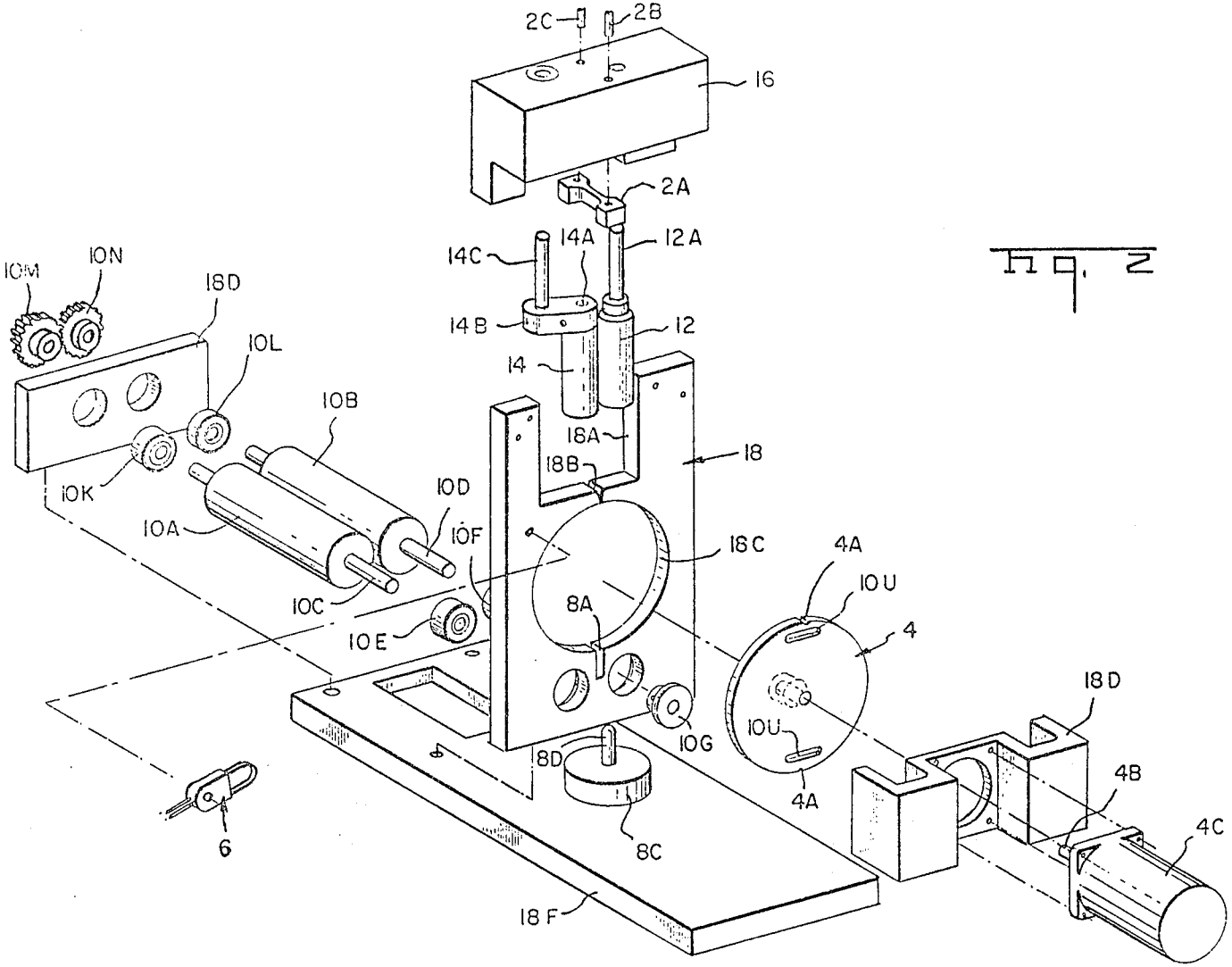
FIG. 2 is an exploded perspective view of the apparatus portion shown in FIG. 1.

FIGS. 1A and 2 illustrate the mechanism 2 which includes a pair of cylindrical rollers 12, 14 rotatable on shafts 12A, 14A. Shaft 12A is mounted directly into a block 16, in turn, mounted onto a frame 18. Shaft 14A is mounted on an eccentric arm 14B, mounted pivotally on a shaft 14C, mounted rotatably in the block 16. The rollers 12, 14 are positioned in a cutout opening 18A in the frame 18.

Figure 5:
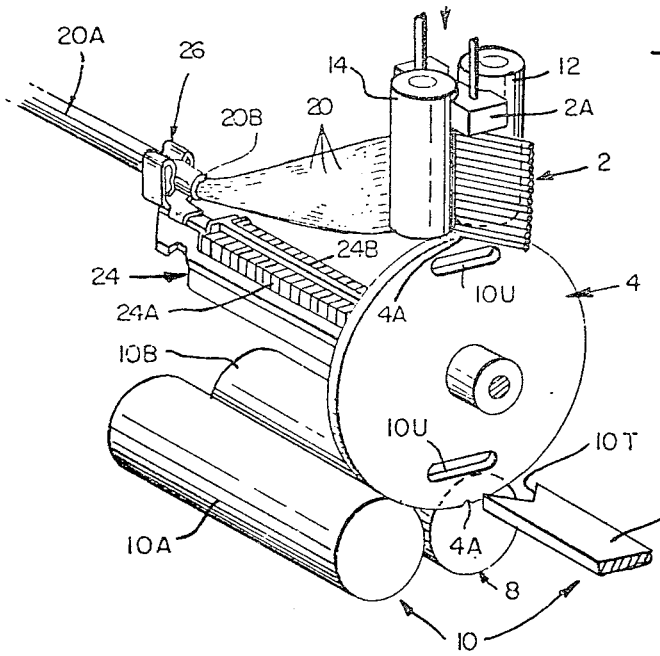
FIGS. 5, 5A and 5B are schematic views of a portion of the apparatus shown in FIG. 4.

FIG. 1A shows the arm 14B provided with a pin 14D mounting one end of a tension spring 14E. The other end of the spring is mounted on a pin 14F projecting from the frame 18. A lever handle 14G (FIG. 1) is secured to the shaft 14C. Pivoting the handle 14G overcomes the spring tension and opens a space between the rollers 12, 14 into which a bundle of wires 20 (FIG. 5) are freely inserted. When the handle is released, the spring pivots the arm 14B to urge the cylindrical surface of the roller 14 toward the cylindrical surface of the roller 12, flattening the bundle of wires 20 into an array of serial wires passing through the restricted space between the rollers.

As shown in FIGS. 2 and 2A, the space between the rollers is aligned with a slot 18B, communicating with the opening 18A, and a circular opening 18C, closely encircling the periphery of the disc 4. The disc 4 has a first notch 4A sized to receive only one wire of the serial array of the wires 20. As shown in FIGS. 1, 2, 4 and 5, the mechanism 2 includes a ram 2A, a thin portion of which is slidable vertically in the space between the rollers 12, 14. The ram pushes against the wires forcing them to drop from the rollers into the slot 18B and then individually into the slot 4A. The ram is mounted onto a pair of rods 2B, 2C slidably mounted in the block 16, and connected to a weight 2D which vertically impels the ram. As the disc 4 rotates, the foremost wire 20 in the notch 4A is pivotally moved together with the notch. As shown in FIG. 2B, the thickness of the disc 4 projects offset from the thickness plane of the frame 18 so that an individual wire 20 in the notch 4A will not be encircled and possibly abraded when the disc rotates.

The disc 4 is mounted for rotation on a shaft 4B of a stepping motor 4C mounted by a bracket 18D to the frame 18. A microprocessor (not shown) activates the motor 4C to rotate the disc in selected fractions of a single revolution.

Initially, the disc is rotated counterclockwise as viewed in FIG. 2A, passing the individual wire 20 against the sensor 6 which includes a knife blade 6A that penetrates insulation on the wire and engages a conductor portion of the wire. The blade 6A detects an identifying electrical signal being carried by each individual wire and transmits the signal via electrical leads 6B to the microprocessor.

Figure 2D:
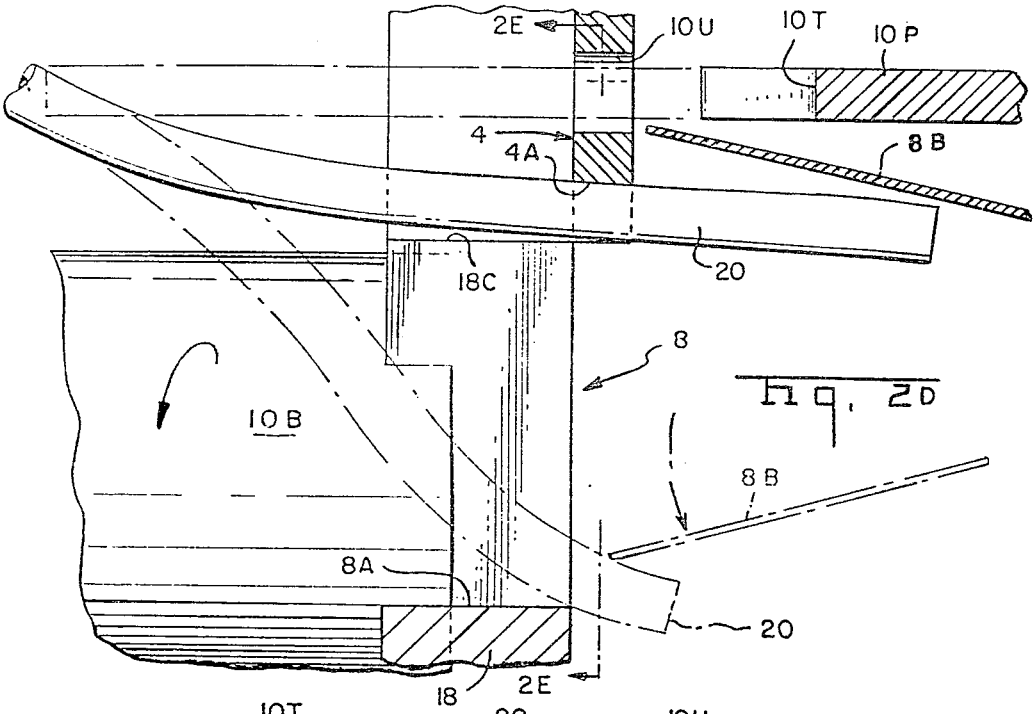
FIG. 2D is an enlarged fragmentary elevation in section of a portion of the apparatus shown in FIG. 3.
Figure 2E:
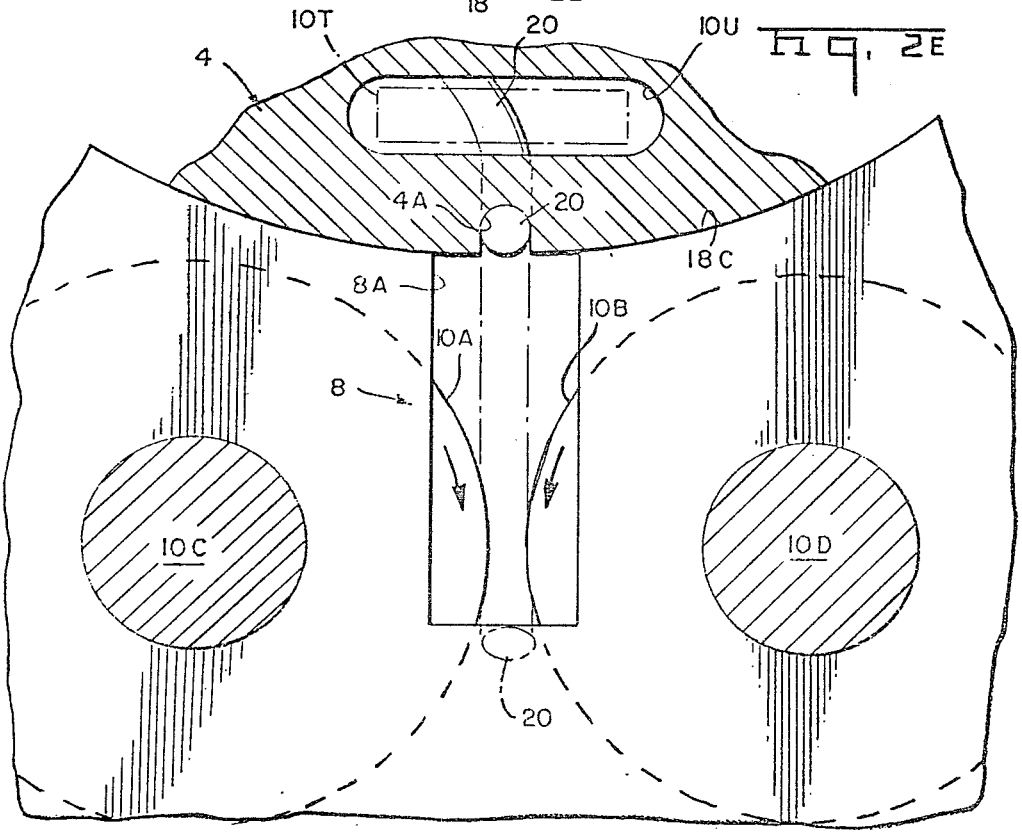
FIG. 2E is a fragmentary section taken along the line 2E—2E of FIG. 2D.
Figure 7:
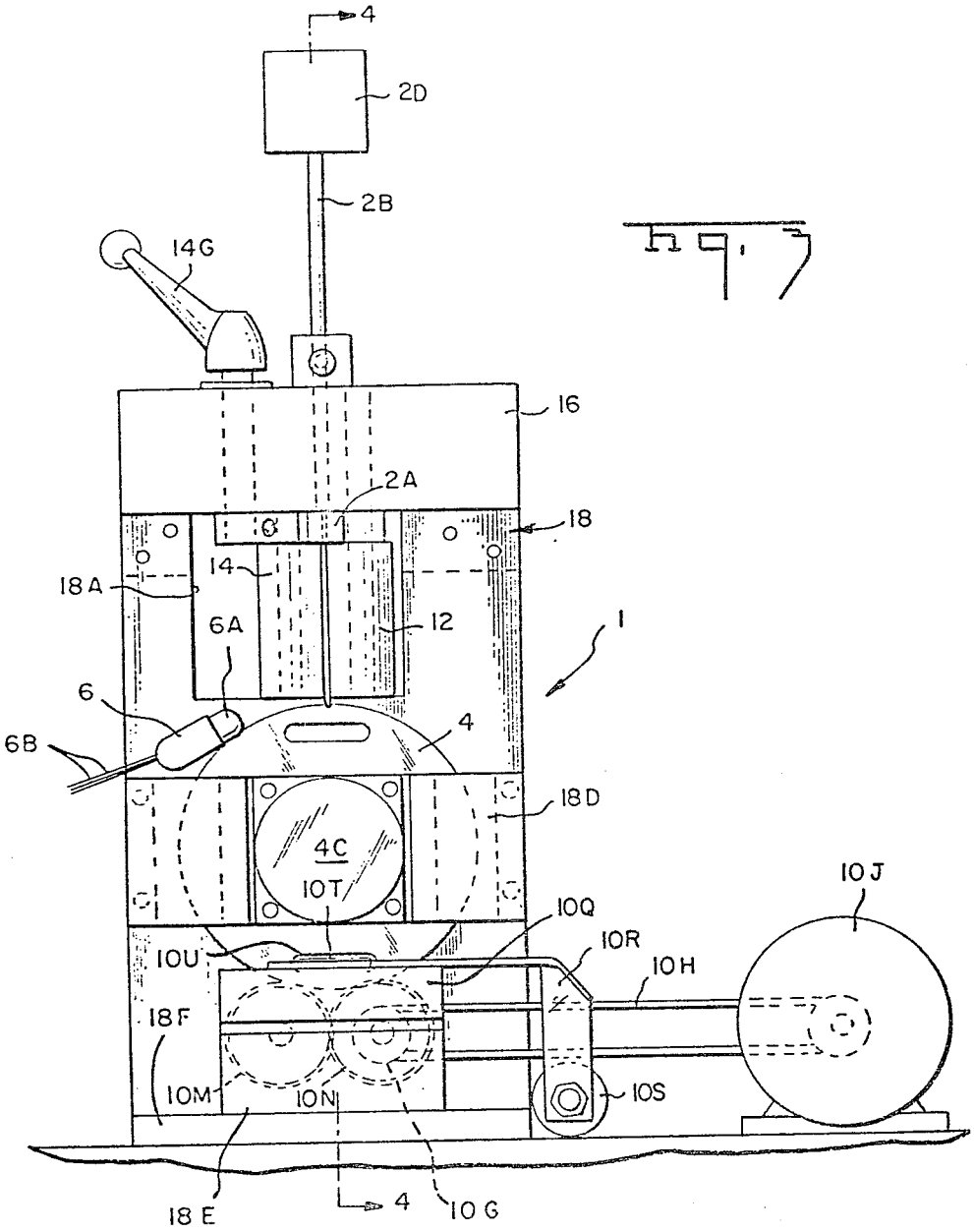

Following detection, the disc rotates the individual wire to the escapement mechanism 8, which includes an escapement slot 8A communicating with the opening 18C, as shown in FIGS. 2, 2D and 2E. The direction of rotation of disc 4 from the sensor 6 to the escapement slot is selected by the microprocessor based upon the detected identity of the individual wire. The wire is transferred from the notch 4A to the slot 8A, at least partially by gravity. A pair of friction drive rollers 10A, 10B grip opposite sides of an individual wire in the slot 8A applying tension on the wire. The rollers 10A, 10B are mounted for rotation on shafts 10C, 10D, in turn, mounted by bearings 10E, 10F to the frame 18. Shaft 10D passes through the frame 18 and mounts a drive pulley 10G. FIG. 3 shows a drive belt 10H connecting the pulley to a continuously operating motor 10J. The opposite ends of the shafts 10C, 10D are mounted in bearings 10K, 10L. The bearings are mounted to a plate 18D of the frame 18. The shafts 10C, 10D are interconnected by gears 10M, 10N for rotation in opposite directions.

Figure 4:
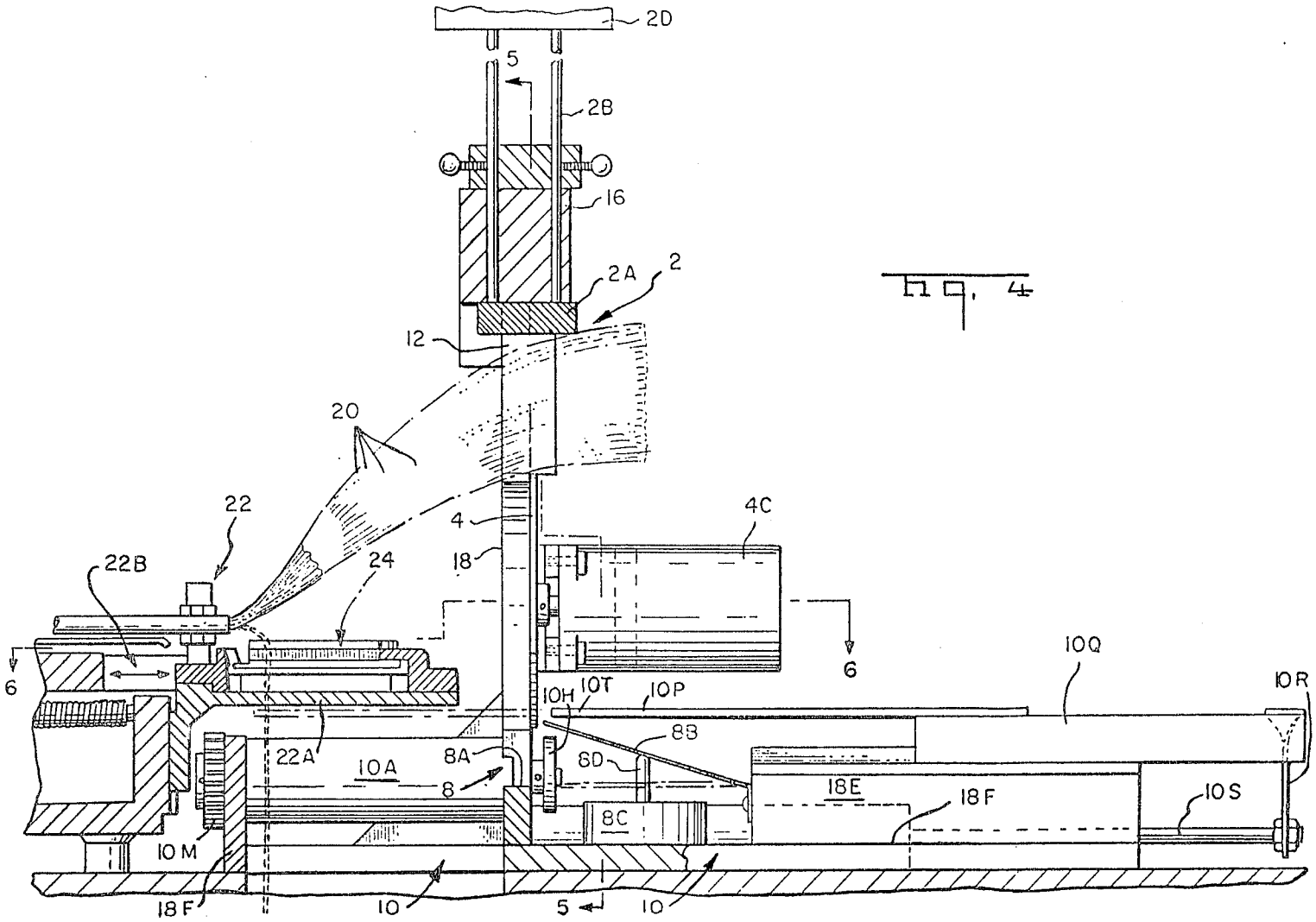
FIG. 4 is a section taken along the line 4—4 of FIG. 3.

The escapement mechanism 8 also includes a cantilever spring, escapement finger 8B, shown in FIGS. 1, 2D and 4. One end of the spring is mounted to a platform 18E, mounted on a bottom plate 18F of the frame 18. A solenoid 8C on the plate 18F has its plunger 8D initially extended, holding the spring elevated as shown in FIGS 1, 2D and 4. When the disc has rotated the notch 4A in alignment with the escapement slot 8A, the solenoid is activated by an electrical signal from the microprocessor. The plunger 8D is retracted, allowing the spring to pivot downwardly as shown in FIG. 2D, wiping an individual wire 20 from the slot 4A, toward and into the space between the rollers 10A, 10B. The solenoid is resettable by itself to lift the spring following a wiping action.

FIGS. 1, 2D and 4 illustrate that transfer mechanism 10 further comprises a reciprocating ram 10P carried on a slide block 10Q which is mounted slidably on the platform 18E. The block 10Q is connected by a strap 10R to the reciprocating piston of an air cylinder 10S (FIG. 3) which is activated by the microprocessor sequentially of the solenoid 8C.

Figure 5A:
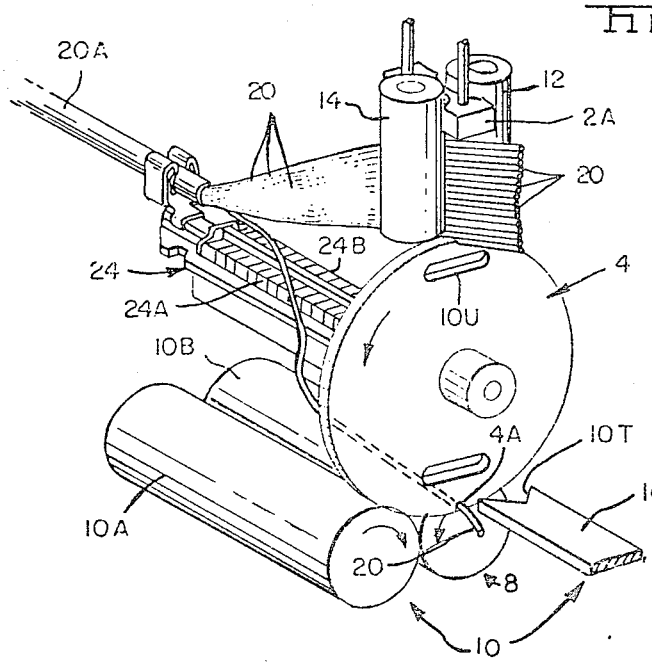
Figure 5B:
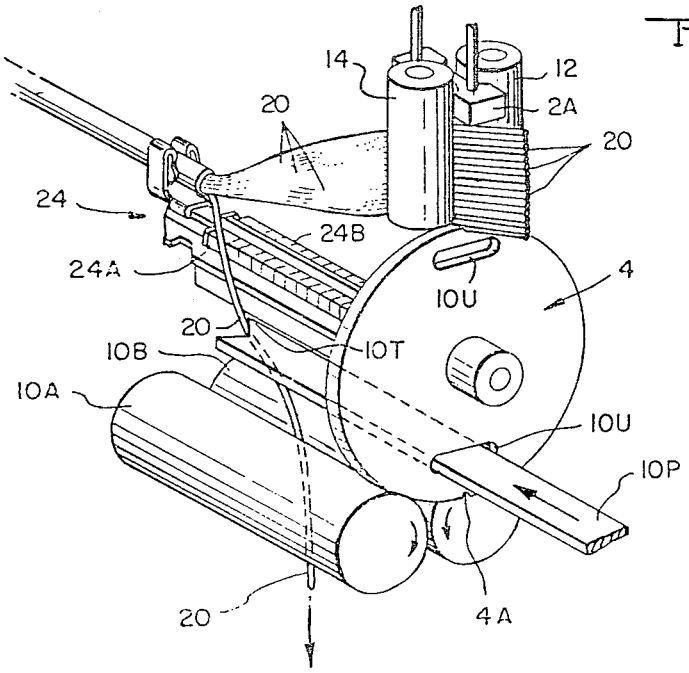

FIGS. 2D, 2E, and 5B illustrate reciprocation of the ram 10P toward the disc 4 when the disc has rotated to deposit an individual wire 20 at the escapement mechanism 8. The ram has a forked end 10T which passes through a slotted opening 10U, through the disc 4 in close proximity to the notch 4A of the disc, engaging the wire 20 and impelling the wire lengthwise along the space between the rollers 10A, 10B. As the rollers apply tension on the wire, the ram assists traverse of the wire lengthwise of the rollers. A second notch 4A of the disc is positioned at the wire-feeding mechanism 2 to receive another wire 20.

FIG. 4 illustrates a wire trimming and inserting mechanism 22 having an anvil 22A extending directly over the rollers 10A, 10B. The anvil mounts an electrical connector half 24. As shown more particularly in FIG. 5, the connector half 24 is mounted in lengthwise alignment with the rollers 10A, 10B. The connector half 24 is provided with a cable clamp 26 of the type disclosed in U.S. Pat. No. 4,211,463, issued July 8, 1980. An electrical communications cable 20A is secured by the clamp. The cable has an outer sheath 20B, a portion of which is removed to expose end portions of the individual wires 20 contained by the sheath. The connector half 24 is either the male or female version disclosed in U.S. Pat. No. 3,760,335, issued Sept. 18, 1973. For purposes of this disclosure, the connector half includes a molded plastic base mounting a first row of electrical contacts with respective solderless wire connecting terminals 24A and a second row of similar contacts with respective terminals 24B. As shown in FIG. 5A, when the disc 4 is rotated counterclockwise to deposit an individual wire 20 at the escapement mechanism 8, the wire will be draped along the row of terminals 24A. As shown in FIG. 5B, the rollers 10A, 10B of the transfer mechanism 10 apply tension on the wire 20, and the ram 10P impels the wire 20 along the row of terminals 24A until the wire is presented to the mechanism 22 which inserts the wire into a selected terminal of the row 24A. If the disc 4 is rotated clockwise, the individual wire deposited at the escapement mechanism 8 will have been draped over the row of terminals 24B and presented by the transfer mechanism 10 to the mechanism 22 for insertion into a selected terminal of the row 24B.

Figure 6:
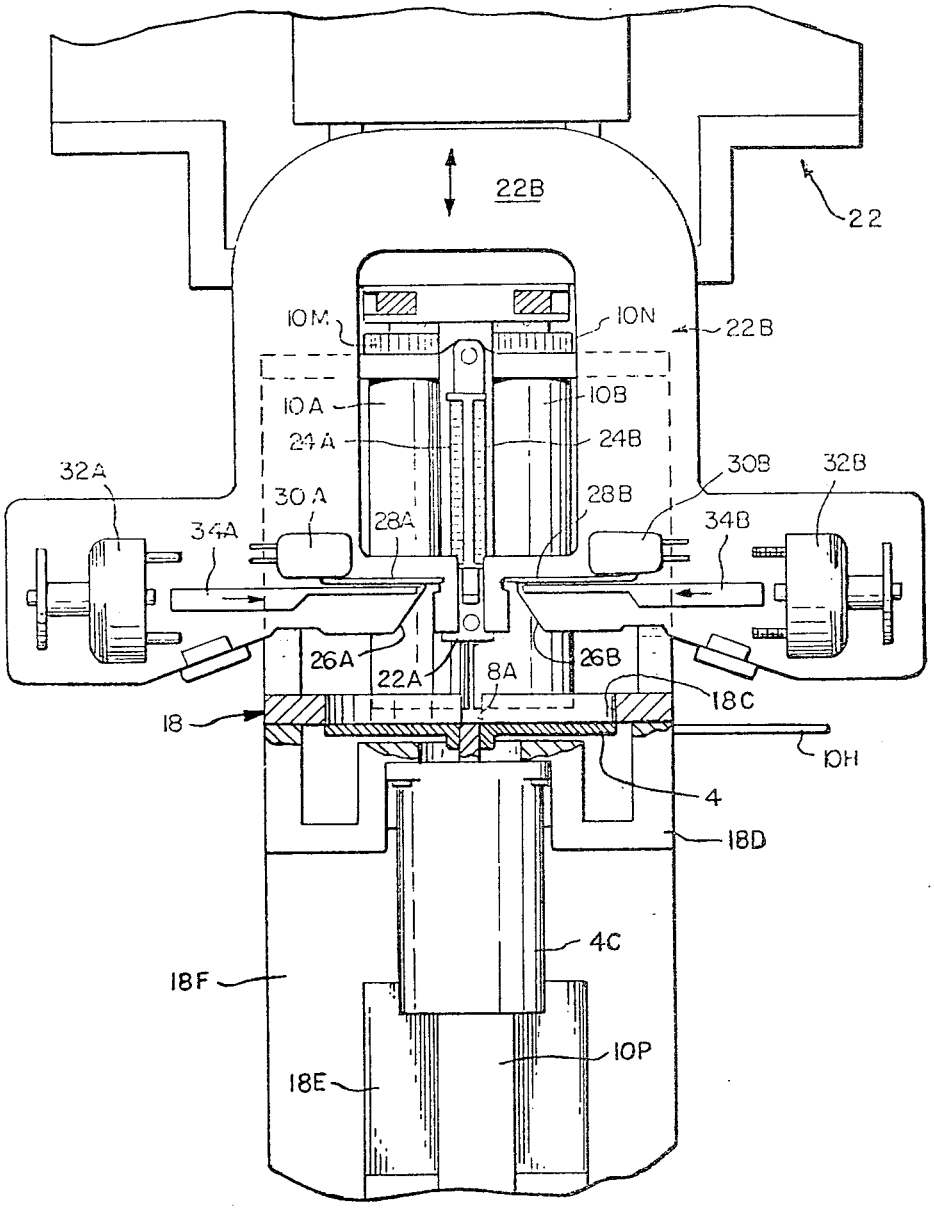
FIG. 6 is a section taken along the line 6—6 of FIG. 4.

Details of the mechanism 22 are disclosed in U.S. Pat. No. 4,238,874. For purposes of this disclosure, the mechanism is shown in FIG. 6 as having a U-shaped yoke 22B which is driven by a stepping motor (not shown) along the anvil 22A and is stopped by the motor at a selected terminal in either of the rows 24A, 24B. The selected terminal is determined by the identity of the individual wire 20 sensed by the sensor 6 and fed to the microprocessor which activates the yoke stepping motor. FIG. 6 illustrates the yoke 22B with a wire entry throat 26A alongside of the row of terminals 24A. The wire 20 is impelled by the ram 10P into the throat 26A striking a lever 28A of a lever activated electrical switch 30A. The switch 30A activates a solenoid 32A, the armature of which is outwardly impelled to drive an insertion ram 34A through the throat 26A, engaging and clipping the wire to length, and inserting the clipped wire into a selected terminal of the row 24A. Similarly, an individual wire which may become draped over the row of terminals 24B will be impelled by the ram 10P into a throat 26B of the yoke 22B, activating a lever portion 28B of a switch 30B, in turn, activating a solenoid 32B which drives an insertion ram 34B through the throat 26B, clipping and inserting the individual wire into a corresponding terminal of the row 24B. The operations are repeated until all the wires 20 are assembled with terminals in the proper color-coded positions in the connector half.

An advantage of the apparatus is that each individual wire 20 is pulled in tension by the rollers 10A, 10B and becomes clipped to the shortest length practicable. Each individual wire will extend from the cable clamp to the respective terminal in the most direct route, so that the bundle of wires at the junction of the cable and the connector half 24 has a wire dress of minimum bulk, maximum flexibility, and neat, orderly appearance.

What is claimed is:

1. Apparatus having a wire-activated, inserting mechanism, means for aligning said inserting mechanism in turn with respective terminals of a row of electrical terminals in an electrical connector half, a frame, a transporting mechanism for grasping single wires individually, in turn, from a random, serial array of color-coded wires, a drive mechanism for pivoting said transporting mechanism, a sensor for receiving an electrical identity signal carried by an individual wire, control means responsive to the sensor output, an escapement mechanism in said frame into which an individual wire is transferred by pivoting of said transporting mechanism, and a transferring mechanism for transferring an individual wire from said escapement mechanism to one of a plurality of color-coded positions, in which said color-coded positions are defined by rows of contacts in an electrical connector half, connector locating means being provided to locate the connector half extending from the same side of the transporting mechanism as said array of wires, said transporting mechanism being pivotable by the control means in a first direction for diverting an individual wire toward one row of terminals, and in a second direction for diverting an individual wire toward another row of terminals, and said transferring mechanism conveying an individual wire outwardly of said escapement means and into said inserting mechanism positioned at a selected terminal of a selected row of terminals by the control means to insert the individual wire into the selected terminal.

2. Apparatus as recited in claim 1, further in which the identification signal received by the sensor determines the direction of pivoting of said transporting mechanism and the position of said inserting mechanism at the selected terminal.

3. Apparatus as recited in claim 1, further in which, said escapement means includes a slot in the transporting mechanism, and the transfer mechanism includes a reciprocating ram communicating with the slot and transferring an individual wire from the escapement means in a direction lengthwise of the selected row of terminals and into the inserting mechanism.

4. Apparatus as recited in claim 3, further in which, the transfer mechanism includes a pivotal finger frictionally engaging an individual wire in the escapement mechanism.

5. Apparatus as recited in claim 1, further in which, the transfer mechanism includes a pivotal finger frictionally engaging an individual wire in the escapement mechanism.

6. Apparatus as recited in claim 1, further in which, the transferring mechanism includes a pair of rotatable rollers applying tension on an individual wire.

7. Apparatus as recited in claim 1, further in which, the transporting mechanism is offset from the thickness of the frame.

8. Apparatus as recited in claim 1, further in which the connector is situated so that pivoting of said transporting mechanism in a first direction drapes an individual wire over one row of terminals and pivoting of said transporting mechanism in a second direction drapes an individual wire over another row of terminals.

9. Apparatus for identifying individual wires of a group of randomly ordered wires and terminating the identified wires in selected terminals of an electrical connector comprising a wire feeding mechanism for feeding the groups of wires arranged as a single row to a wire transporting wheel adapted to trap an individual wire at its periphery and mounted for axial rotation past the wire feeding mechanism thereby to transport individual wires one-by-one from the wire feeding mechanism to an escapement; means to sense the identity of an individual wire; control means responsive to the sensing means output; a wire terminating mechanism including means to mount an electrical connector having a row of terminals opposite a wire terminating ram; and, a wire transferring mechanism for transferring a wire from the escapement to the wire terminating mechanism, in which apparatus, the mounting means is arranged to mount the connector with the row of terminals and the wire group extending axially from one side of the wire transporting wheel, the wire terminating ram being operable by the control means to move relatively along the terminal row into alignment with respective terminals in response to the identity of an individual wire and the transferring mechanism being arranged to transfer the individual wire in the axial direction from the escapement into alignment with the terminating ram.

10. Apparatus according to claim 9 in which the wire transporting wheel is operable by the control means to rotate in either direction away from the feeding mechanism to direct an individual wire towards a selected one of two rows of terminals on respective opposite sites of the connector in response to the identity of the individual wire.

11. Apparatus according to claim 9 in which the transfer mechanism includes a pair of rollers extending in parallel relation between the escapement and the terminating mechanism, and arranged to rotate in opposite senses to grip and transfer a wire from the escapement to the terminating mechanism.

12. Apparatus according to claim 9 in which the escapement includes a wire receiving slot extending radially from the periphery of the wheel and the transfer mechanism includes an arm mounted to reciprocate in the axial direction past the slot into engagement with the wire to transfer the wire to the wire terminating mechanism.

13. Apparatus according to claim 12 in which the escapement includes a finger arranged to draw a wire along the slot away from the wheel during operation of the transfer mechanism.

* * * * *